US005651571A

United States Patent [19]

Diveto

[11] Patent Number: 5,651,571

[45] Date of Patent: Jul. 29, 1997

[54] GOLF BALL RETRIEVER

[76] Inventor: Albert Diveto, 208 William St., Stayner, Canada, L0M 1S0

[21] Appl. No.: 657,154

[22] Filed: Jun. 3, 1996

[51] Int. Cl.[6] ..... A63B 47/02

[52] U.S. Cl. ..... 294/19.2

[58] Field of Search ..... 294/19.1, 19.2, 294/24, 66.1, 99.1; 56/328.1, 332; 224/919; 273/32 D, 32 F, 162 E, 162 F

[56] References Cited

U.S. PATENT DOCUMENTS

| | | | |
|---|---|---|---|
| 713,672 | 11/1902 | Oliver | 294/19.2 |
| 2,810,252 | 10/1957 | Kelly | 294/19.2 X |
| 2,814,520 | 11/1957 | Ruhland | 294/19.2 |
| 3,029,097 | 4/1962 | Ward | 294/19.2 |
| 3,136,573 | 6/1964 | Harke | 294/19.2 |
| 3,149,872 | 9/1964 | Ward | 294/19.2 |
| 4,313,632 | 2/1982 | King | 294/19.2 |
| 5,080,413 | 1/1992 | Vobeda | 294/19.2 |

FOREIGN PATENT DOCUMENTS

| | | | |
|---|---|---|---|
| 901825 | 7/1962 | United Kingdom | 294/19.2 |

*Primary Examiner*—Johnny D. Cherry

[57] ABSTRACT

In a manually operated tool for retrieving a golf ball submerged in water, it is known to consist of multiple interacting telescopic tubes, a cylindrical retrieval cup and an elasticated cord. In this invention one end of the cylindrical cup is bisected by the elasticated cord, which, when placed over the golf ball is stretched and returned to the original position when passed by the golf ball and secures the golf ball within the cylinder. The opposing aperture of the cylinder has an extended tongue for the maneuvering of a golf ball where the retrieval is restricted from above its original position.

5 Claims, 4 Drawing Sheets

GOLF BALL RETRIEVER

FIELD OF INVENTION

This invention relates to the outdoor sport of golf and the area of golf ball retrieval from such hazards on a golf course where a golf ball may be submerged in water.

BACKGROUND OF INVENTION

This invention relates to a manually operated tool required to effectively retrieve golf balls submerged in water.

Current inventions available on the market require the part of the tool designed to capture the golf ball to be moved on a horizontal plane thereby disturbing the position of the golf ball.

I believe that there is no existing invention that uses the operation or method of capture and retrieving of a golf ball that have been encompassed within my invention.

SUMMARY OF INVENTION

As such, the general purpose of this invention is to provide a new more effective method of capturing a golf ball submerged in water that is not presently achieved in any prior art in that this invention provides a more versatile and effective tool for retrieving a submerged golf ball. The tool for capturing and retrieving a golf ball consists of a series of telescopic tubes forming a shaft and a funnel shaped cylinder, of which the largest diameter is bisected by an elasticated cord. The manual operation of this tool is to lower the largest diameter of the cylinder over the golf ball, whereby the elasticated cord is stretched over the diameter of the golf ball and then returned to its original position thus occurring the golf ball within the cylinder. Where the retrieval of a golf ball is restricted from above, the smaller diameter of the cylinder is used on a horizontal plane with the addition of the extended tongue used to guide the golf ball into the cylinder. Once a golf ball has entered the retrieval cylinder, it may be retrieved by the operator by either retracting or directing the telescopic shaft from the water hazard.

BRIEF DESCRIPTION OF DRAWINGS

The embodiment of the invention is now described, by way of example with reference to the accompanying drawings, of which.

DETAILED DESCRIPTION OF THE INVENTION

Figure 2:
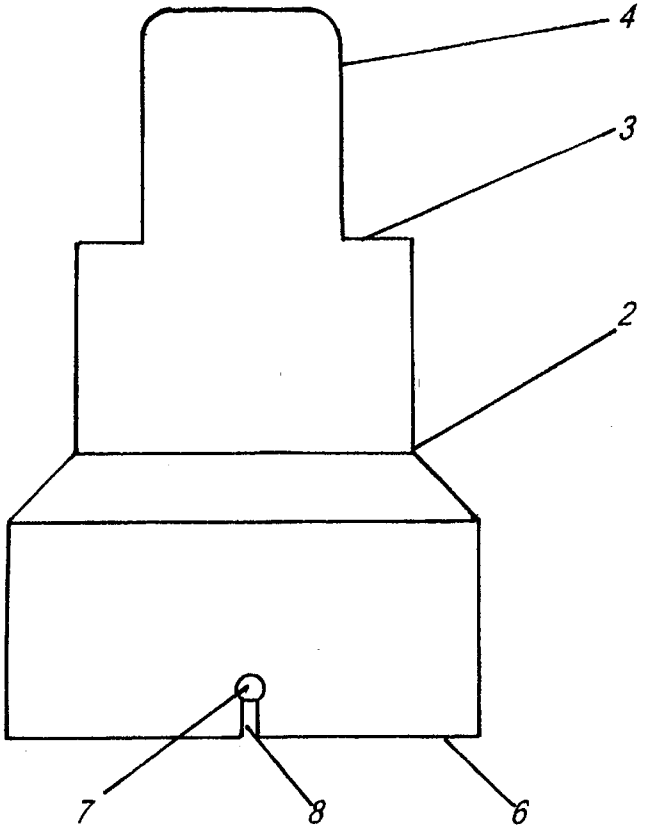
FIG. 2. is a rear perspective view of the retrieval cylinder
Figure 1:
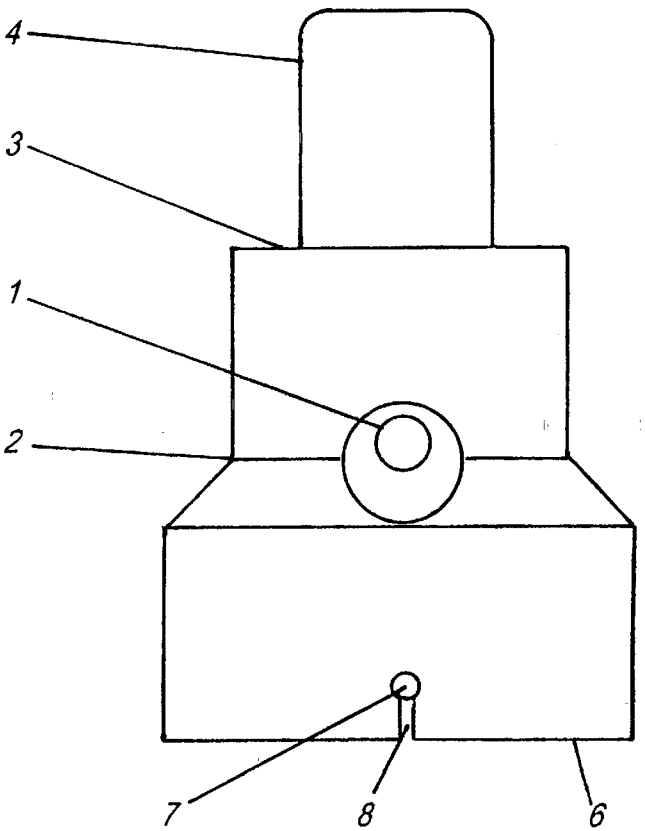
FIG. 1. is a front perspective view of the retrieval cylinder
Figure 4:
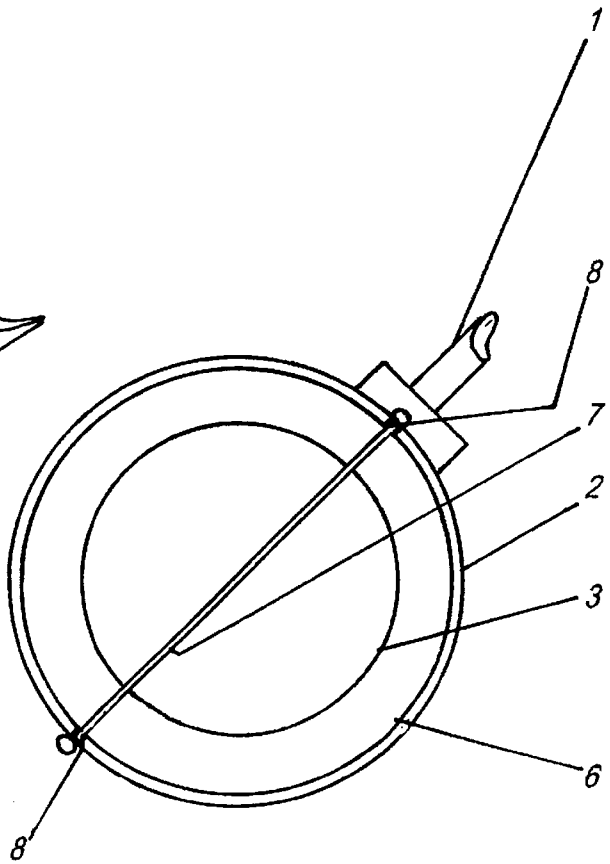
FIG. 4. is a perspective view from below the retrieval cylinder
Figure 3:
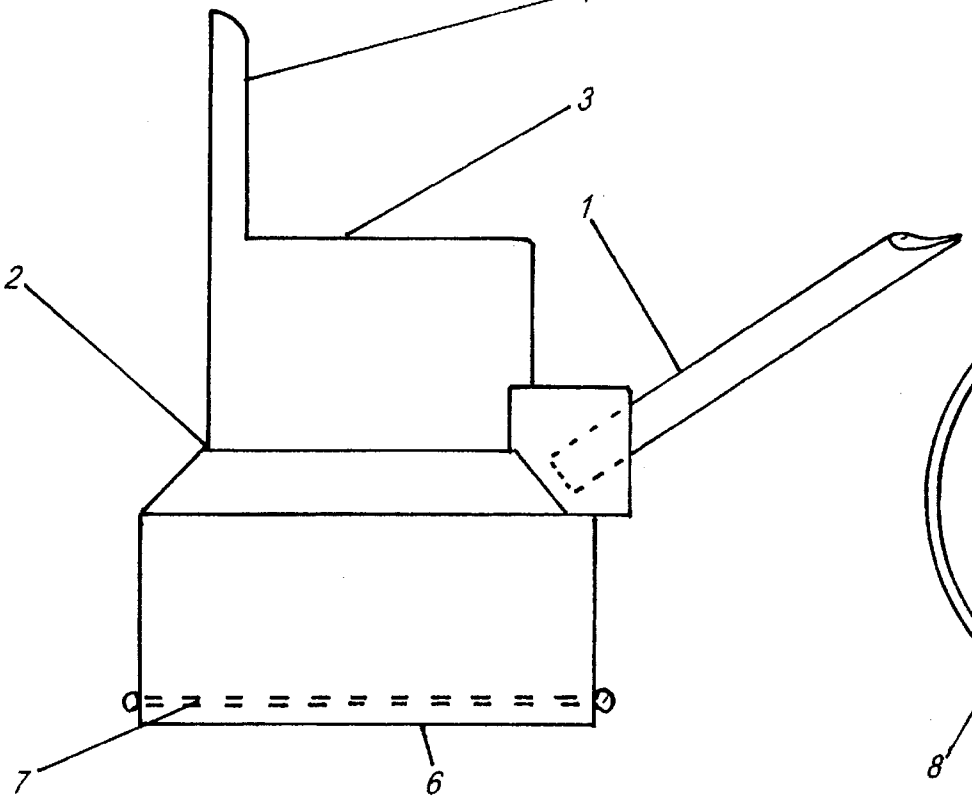
FIG. 3. is a side perspective view of the retrieval cylinder
Figure 6:
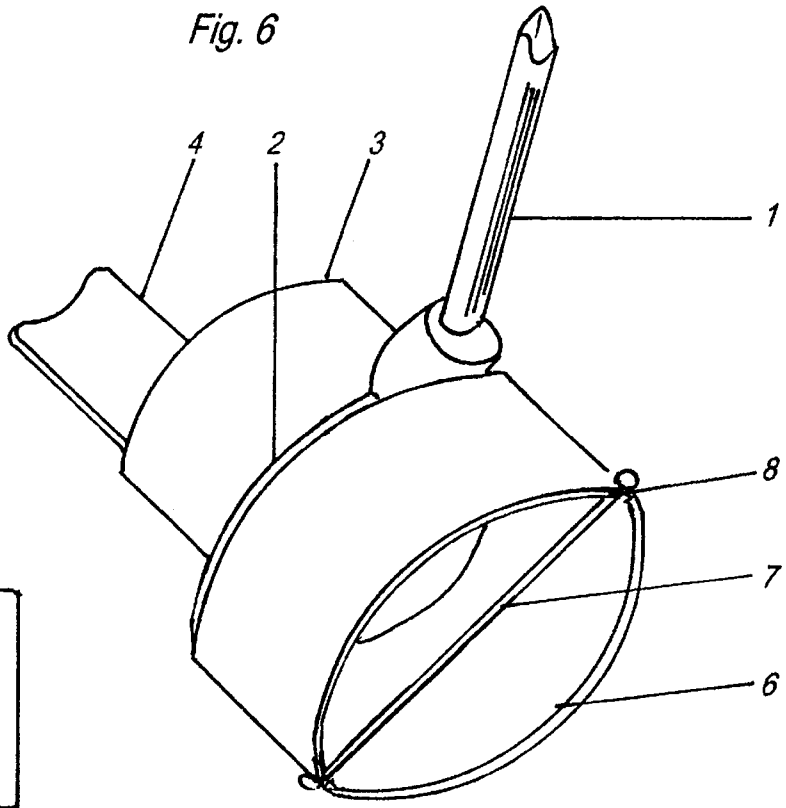
Figure 5:
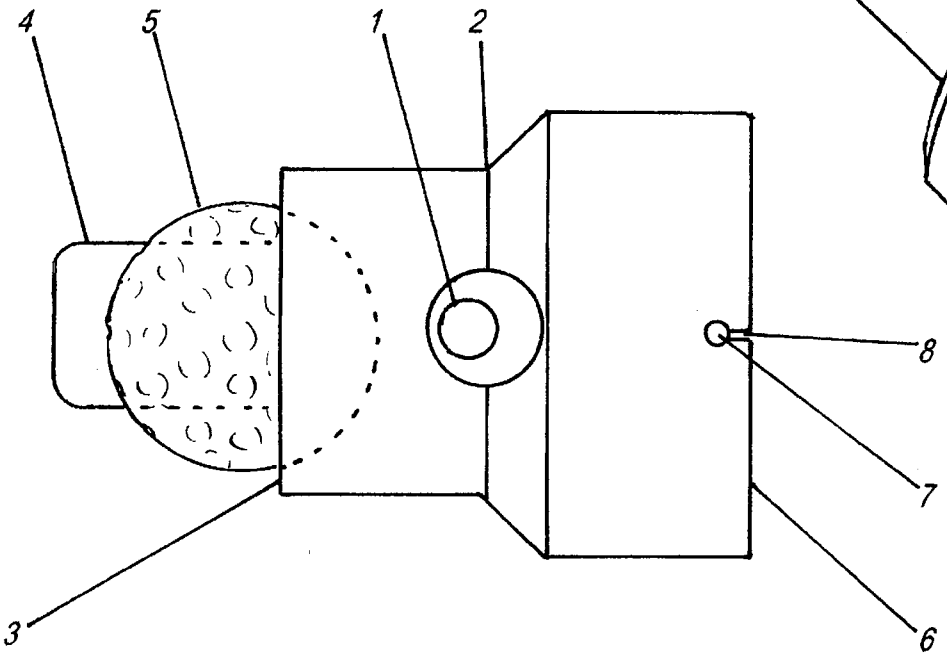
FIG. 5. is a perspective view of the golf ball entering the cylinder via the unobscured end of the cylinder FIG. 6. is an overall perspective view of the retrieval cylinder and cord FIG. 7. is a perspective view of the retrieval cylinder being descended over the golf ball FIG. 8. is a perspective view of the retrieval cylinder and the elasticated cord in operation FIG. 9. is a perspective view of the golf ball captured and secure within the retrieval cylinder.

The invention consists of a cylindrical head 2, as seen in FIG. 1, with an opening 6, which tapers inward toward the center of the head 2 forming a cone-like structure. Opening 6 incorporates an elastic cord 7 that bisects the opening and is held in place within notches 8 located on the outer rim, of opening 6, directly opposing each other. Opening 3 is of a smaller diameter than that of opening 6 but is of a greater circumference than that of a golf ball. Tongue 4 extends from the rim of opening 3. Handle 1, partially shown in FIG. 1 through FIG. 9, would be well suited to the widely used, telescoping, multi-sectional, aluminum, units and affixes to the cylindrical head 2 of the retriever at a suitable angle as shown in FIG. 3 as to afford ease of use in placing the "head" 2 over a golf ball that would always be in a lower position than the user.

Figures 7, 8, 9:
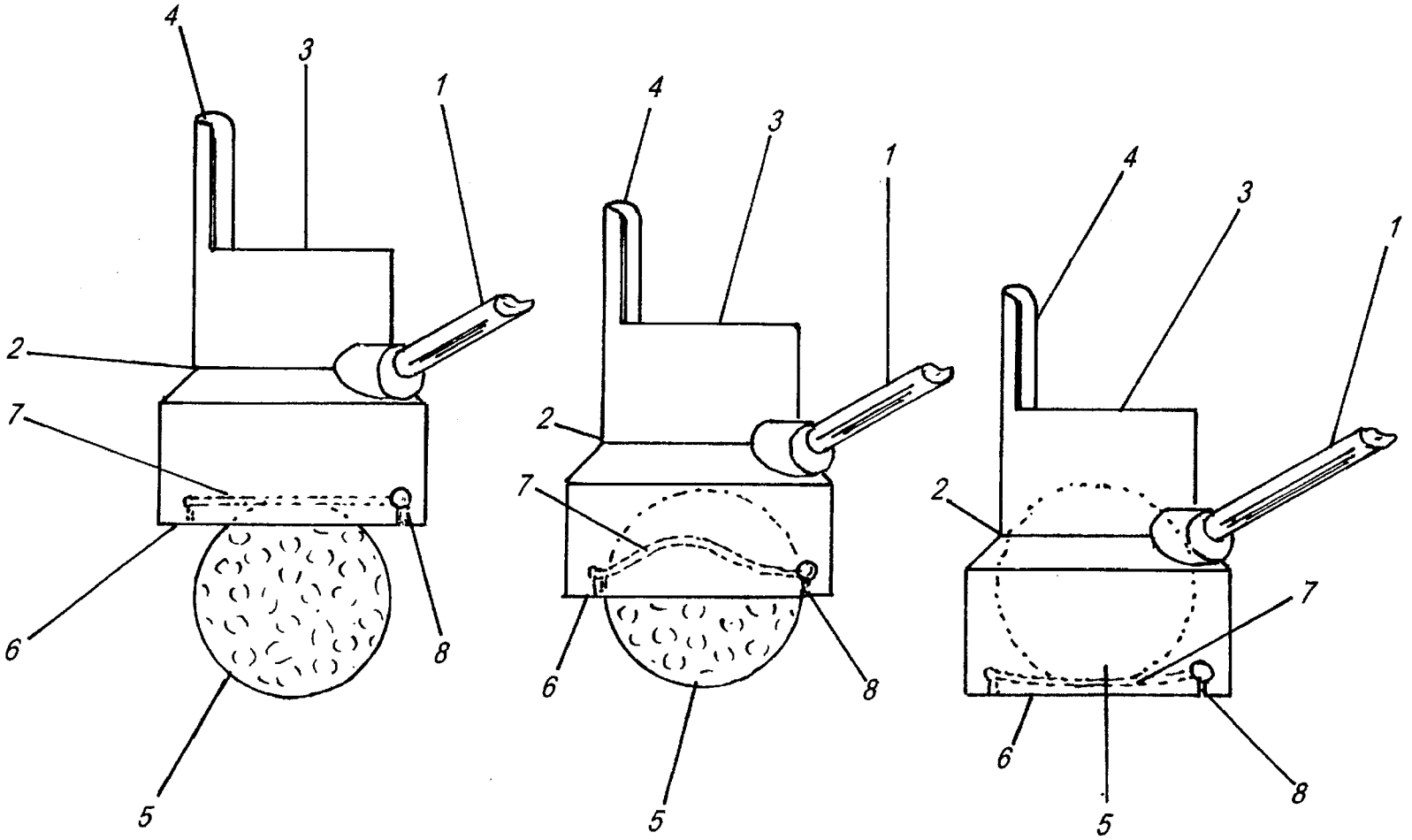

In operation, when one wants to retrieve a golf ball from a water or other hazard, one would, as in FIG. 7, place large opening 6 of cylindrical head 2, over the golf ball 5. The weight of the retriever causes cylindrical head 2 and opening 6 to descend over ball 5 as shown in FIG. 8 and FIG. 9. Golf ball 5 displaces elastic cord 7 to one side or the other of opening 6 as in FIG. 8 allowing golf ball 5 to enter the confines of cylindrical head 2. Elastic cord 7 returns to original position as in FIG. 9 entrapping golf ball 5 in cylindrical head 2. Opening 6 has a much larger diameter than that of a golf ball making it very easy to place over a golf ball in visually impaired situations such as those that occur under water. When the golf ball lights on a surface that is too soft to withstand the weight of the golf ball retriever, such as a pond bottom, and this weight would cause the ball to be pushed into the soft surface and be lost, opening 3 would be used, as in FIG. 5, with tongue 4, which is used as a "scoop" to guide the ball 5 into opening 5. Cylindrical head 2 is tamed sideways and tongue 4 is placed behind the golf ball 5. This allows the operator to be aware of the position of the ball and use the tongue 4 as a guide and scoop to direct the ball 5 successfully into opening 3. Cylindrical head 2 is then turned upright with opening 3 and tongue 4 being at the, top most-position and golf ball 5 being securely ensconced in cylindrical head 2 and prohibited from falling through opening 6 by elastic cord 7. The device is then moved to a "safe area," away from water or other hazard, where the ball can be removed by hand or by mining the cylindrical head 2 so that the golf ball 5 is allowed to exit from opening 3.

This device could be molded in one piece in plastic with the elastic cord, being of a suitable thickness as to allow the golf ball to push by it easily and be taut enough to hold the ball securely within the cylindrical head, being snapped into the notches afterward. The golf ball retriever "head" could then be attached to a suitable handle, such as a multi sectional telescopic unit.

It is accepted that changes or modifications may be made to meet specific requirements. Such changes may be made without departing from the scope and spirit of the invention.

The embodiment of the invention in which exclusive property or privilege is claimed are defined as follows:

1. A golf ball retriever device having in combination:

(a) A handle, (b) A cylindrical head mounted to one end of said handle at an angle such as to make the retrieval of a golf ball much easier for the average user, (c) The cylindrical head consisting of a first opening, in what would be the lower or bottom position during operation, having a diameter large enough to facilitate the entry of a golf bail in awkward situations and (d) Also having an elastic cord bisecting this opening for the capture and entrapment of golf balls and being secured to the cylindrical head in notches being of a much smaller diameter than that of the cord, (e) The cylindrical head consisting of a second opening, in what would be the upper or top position that would be turned to the side during operation, having a diameter large enough to accept a golf ball easily and (f) Also having a tongue or scoop projecting from the rim edge of the second opening, which would be furthest from the user.

2. The golf ball retriever device of claim 1 wherein said first opening in the lower position has a much larger diameter than that of a golf ball.

3. The golf ball retriever device of claim 1 wherein said elastic cord when in operation has such flex as to allow a golf ball to displace or push the cord to one side or the other as it passes into the cylindrical head and suitable tension as to hold the ball securely during normal operation.

4. The golf ball retriever device of claim 1 wherein said second opening in the upper position has a larger diameter than that of a golf ball.

5. The golf ball retriever device of claim 1 wherein said tongue or scoop projecting from the rim edge of the second opening is of suitable length as to be useful as a sight guide and a physical guide in assisting the operator to retrieve a golf ball into said second opening.

* * * * *